US009797140B1

(12) United States Patent
Conklin

(10) Patent No.: US 9,797,140 B1
(45) Date of Patent: Oct. 24, 2017

(54) SKYLIGHT FRAMING SYSTEM

(71) Applicant: Wayne Conklin, Butler, NJ (US)

(72) Inventor: Wayne Conklin, Butler, NJ (US)

( * ) Notice: Subject to any disclaimer, the term of this patent is extended or adjusted under 35 U.S.C. 154(b) by 166 days.

(21) Appl. No.: 14/839,294

(22) Filed: Aug. 28, 2015

(51) Int. Cl.

| | |
|---|---|
| ***E04D 13/03*** | (2006.01) |
| ***E04B 7/18*** | (2006.01) |
| ***E06B 3/663*** | (2006.01) |
| ***E06B 3/66*** | (2006.01) |
| ***E06B 3/67*** | (2006.01) |

(52) U.S. Cl.
CPC ..... *E04D 13/0315* (2013.01); *E04B 7/18* (2013.01); *E04D 13/03* (2013.01); *E06B 3/66* (2013.01); *E06B 3/663* (2013.01); *E06B 3/66304* (2013.01); *E06B 3/6715* (2013.01)

(58) Field of Classification Search
CPC ..... E04D 13/03; E04D 13/0315; E04D 13/0325; E04D 13/12; E04D 13/00; E04D 13/0335; E04D 13/0305; E04B 7/18; E06B 3/66304; E06B 3/6715; E06B 3/66352; E06B 3/33361; E06B 3/66385; E06B 3/66; E06B 3/663; E06B 3/66314
USPC ..... 52/786.13, 200, 656.9, 172
See application file for complete search history.

(56) References Cited

U.S. PATENT DOCUMENTS

| | | | | |
|---|---|---|---|---|
| 1,971,160 | A * | 8/1934 | Lenke | E04D 13/03 52/200 |
| 2,193,393 | A | 3/1940 | Danner | |
| 2,618,819 | A | 11/1952 | Goodwillie | |
| 4,074,480 | A | 2/1978 | Burton | |
| 4,222,213 | A | 9/1980 | Kessler | |
| 4,294,649 | A | 10/1981 | Sarka | |
| 4,431,691 | A | 2/1984 | Greenlee | |
| 4,479,988 | A | 10/1984 | Dawson | |
| 4,520,602 | A | 6/1985 | Miller | |
| 4,720,951 | A * | 1/1988 | Thorn | B29C 44/18 49/DIG. 2 |
| 4,994,309 | A | 2/1991 | Reichert et al. | |

(Continued)

FOREIGN PATENT DOCUMENTS

| | | |
|---|---|---|
| AU | B4022989 | 3/1990 |
| AU | B5464990 | 11/1990 |

(Continued)

*Primary Examiner* — Joshua J Michener
*Assistant Examiner* — Matthew Gitlin
(74) *Attorney, Agent, or Firm* — Goldstein Law Offices, P.C.

(57) ABSTRACT

A skylight assembly, having framing members that define an interior space and rafters that span the interior space between framing members, for supporting panes of glass, each pane having at least one structural glass panel and a thermal panel. The framing members each have a vertical portion and support assembly extending inwardly, including an upper support surface, a lower support surface, and a vertical step therebetween. A glass setting block made of a rubbery material rests upon the upper support surface, vertical step, and lower support surface. The structural glass panels are fully supported by the upper support surface. The thermal panel is supported by the lower support surface, and is sealed to the upper support surface by a spacer, forming an insulating glass unit therewith. The full support of the structural glass, independent of the support of the thermal panel, allows the skylight to be thermally insulated and walkable.

12 Claims, 8 Drawing Sheets

(56) References Cited

U.S. PATENT DOCUMENTS 4,999,964 A 3/1991 Taylor
5,003,744 A 4/1991 Taylor
5,042,210 A 8/1991 Taylor
5,087,489 A 2/1992 Lingemann
5,088,258 A 2/1992 Schield et al.
5,207,036 A 5/1993 Sampson et al.
5,216,855 A * 6/1993 Richter ..... E04D 13/0305 49/DIG. 2
5,218,806 A 6/1993 Taylor
5,424,111 A 6/1995 Farbstein
5,682,713 A * 11/1997 Weiss ..... E04D 13/031 403/231
5,913,785 A * 6/1999 Møller ..... E04D 13/0305 49/DIG. 1
6,715,245 B2 * 4/2004 Lewkowitz ..... E06B 7/30 52/204.53
6,830,791 B1 * 12/2004 Misonou ..... B32B 17/10055 428/34
7,296,388 B2 * 11/2007 Valentz ..... E04D 13/0305 52/200
7,762,028 B2 * 7/2010 Valentz ..... E04D 13/0315 52/200
8,028,478 B2 * 10/2011 Valentz ..... E04D 13/0315 52/200
8,225,560 B2 * 7/2012 Valentz ..... E04D 13/0315 52/200
8,225,561 B2 7/2012 Voegele, Jr. et al.
8,291,674 B2 10/2012 Valentz et al.
8,381,490 B2 2/2013 Back et al.
8,393,120 B2 * 3/2013 Valentz ..... E04D 13/0305 52/200
8,397,468 B2 3/2013 McClure
8,701,362 B2 4/2014 Stone
8,833,010 B1 * 9/2014 Schlabach ..... E04D 13/03 52/200
2006/0272232 A1 12/2006 Fooks
2009/0110866 A1 4/2009 Ainz et al.
2010/0269426 A1 * 10/2010 Richter ..... E04D 13/0315 52/171.3
2013/0118100 A1 * 5/2013 Valentz ..... E04D 13/0305 52/200
2014/0109499 A1 4/2014 Nieminen et al.

FOREIGN PATENT DOCUMENTS

CA 2015714 11/1990
CA 1328970 5/1994
EP 0356374 2/1990
EP 0396075 11/1990
GR 3017183 11/1995
IE 62450 2/1995
IE 67796 5/1996
MX 165468 11/1992
MX 172717 1/1994
NZ 230417 3/1993
WO WO2004042164 5/2004
WO WO2005019561 3/2005
WO WO2007011561 1/2007
WO WO2009056186 5/2009
WO WO2012041325 4/2012
WO WO2014066385 5/2014

* cited by examiner

SKYLIGHT FRAMING SYSTEM

TECHNICAL FIELD

The present disclosure relates generally to a skylight framing system. More particularly, the present disclosure relates to a framing system for providing a skylight assembly that is both walkable and thermally insulated.

BACKGROUND

Skylights have traditionally been used to provide additional illumination through standard roofing structures. Generally they were not intended, and thus not designed, to support the weight of one or more persons walking upon them.

Over the past several decades, nearly all new windows in residential and commercial buildings have more than one pane of glass and some type of thermally insulative structure or insulating glass unit (IGU). Typically they involve panes of glass separated by a thermal break spacer and sometimes involve evacuating the space in between or filling it with a noble gas such as argon or krypton. As these structures are typically not load bearing, the materials used to fabricate such structures are generally lightweight and can be produced off-site in a manufacturing facility.

Modern trends in building design often desire making rooftop surfaces into useable and even public spaces. This goal has made "walkable" skylights part of more and more building designs.

Walkable skylights must be designed to support the additional loading potential of numerous people walking and standing upon them. Accordingly, typically several layers of thick glass are employed. Supporting these glass panels requires robust framework.

Unfortunately, thick heavy glass, being supported by robust framework is incompatible with current thermal glass technology, such as currently used to create insulating glass units. Thus, while architects desire the aesthetics and functionality of walkable skylight units, such aspirations must compete with the goal of creating an energy efficient building.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a skylight framing system that is walkable and energy efficient. Accordingly, the present disclosure provides a framing system that supports heavy duty, load bearing, structural glass panels, and provides separate support for one or more thermal panels adjacent to the load bearing glass.

It is another aspect of an example embodiment in the present disclosure to provide a skylight framing system that provides heat and water insulating properties. Accordingly, the outer framing includes a resin filled thermal break, and the system employs glass setting blocks configured to work in conjunction with the framing, the structural glass, and thermal panels.

It is yet another aspect of an example embodiment in the present disclosure to provide a skylight framing system that adjusts to variations in thicknesses of the structural glass panels. Accordingly, the framing system may employ an adjustable cap that provides sufficient variation in upper height of the framing members, for easy adjustment at the time of installation.

Accordingly, the present disclosure describes a skylight assembly, having framing members that define an interior space and rafters that span the interior space between framing members, for supporting panes of glass, each pane having at least one structural glass panel and a thermal panel. The framing members each have a vertical portion and support assembly extending inwardly, including an upper support surface, a lower support surface, and a vertical step therebetween. A glass setting block made of a rubbery material rests upon the upper support surface, vertical step, and lower support surface. The structural glass panels are fully supported by the upper support surface. The thermal panel is supported by the lower support surface, and is sealed to the upper support surface by a spacer, forming an insulating glass unit therewith. The full support of the structural glass, independent of the support of the thermal panel, allows the skylight to be thermally insulated and walkable.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
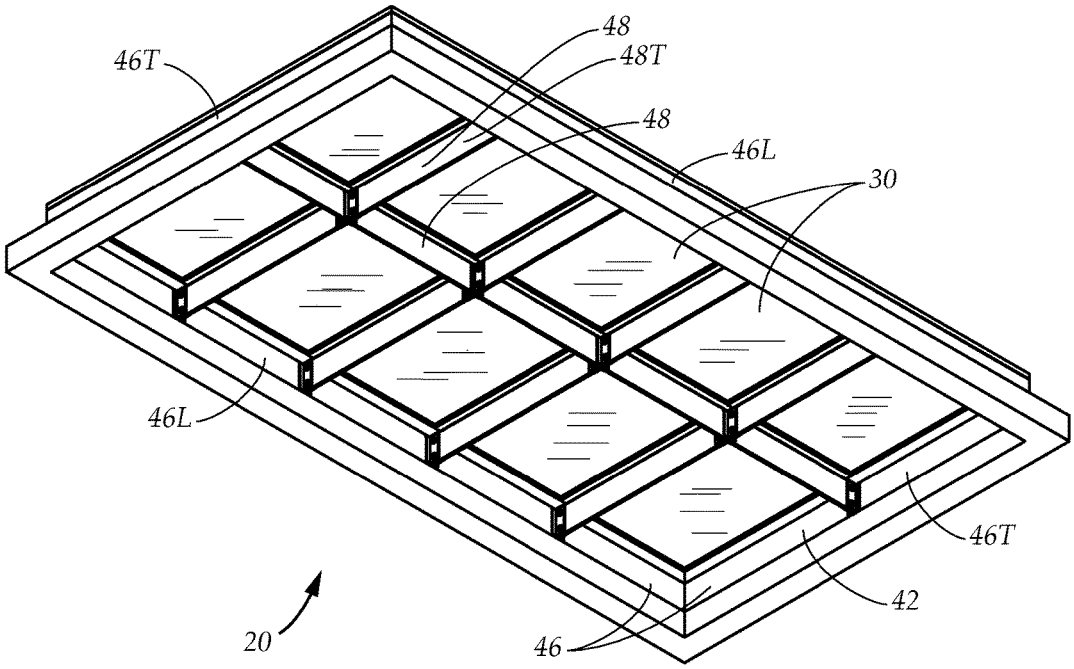
FIG. 1 is diagrammatic perspective view, showing a skylight assembly generally from below, as an interior view, employing a framing system according to the present disclosure.
Figure 2:
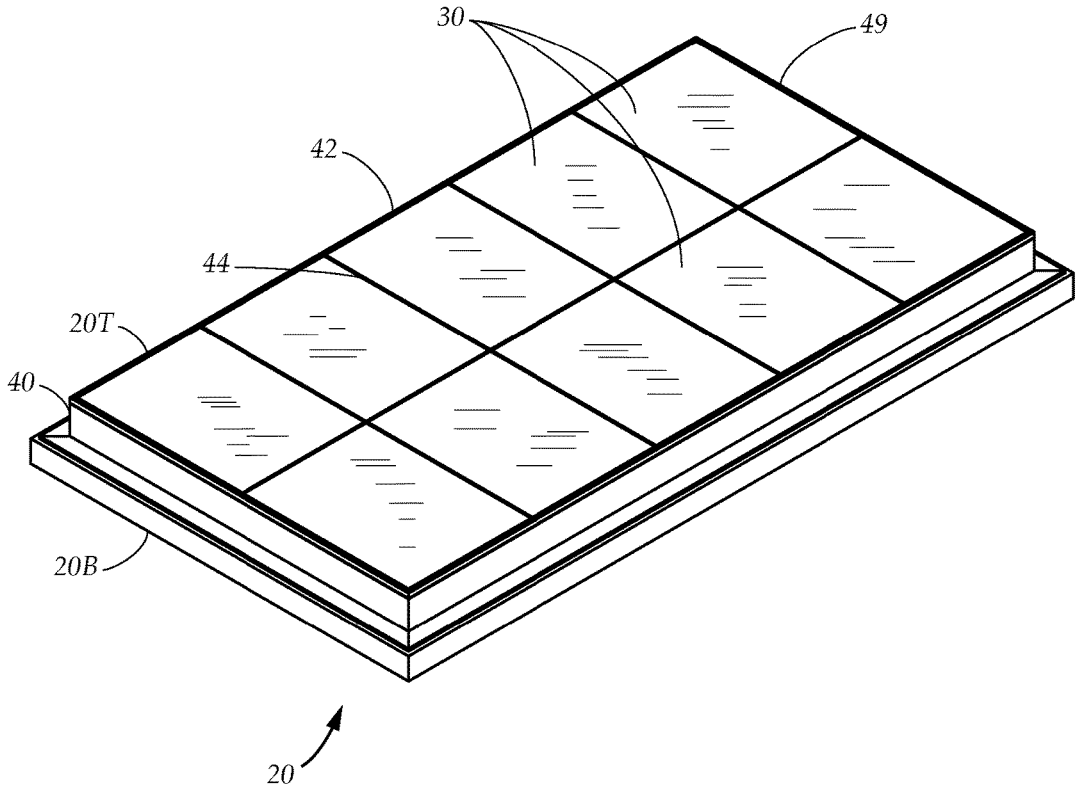
FIG. 2 is a diagrammatic perspective view, showing the skylight assembly of FIG. 1, generally from above, showing an exterior of the framing system.

FIG. 1 and FIG. 2 illustrate a skylight unit 20. The skylight unit has a top 20T and a bottom 20B. The skylight unit 20 includes a frame 40 and a plurality of skylight panes 30, which each may include several layers, sheets, lites, or panels of glass, as will be described hereinafter.

The frame 40 includes an outer frame 42 and an inner frame 44. The outer frame 42 includes several framing members 46, namely a pair of longitudinal framing members 46L and a pair of transverse framing members 46T. The framing members 48 together define an interior space 49, which is generally spanned by the panes 30. The inner frame 44 extends between and within the outer frame 42—within the interior space 49, and includes rafters 48, namely transverse rafters 48T and at least one longitudinal rafter 48L. The framing members 46L, 46T, and rafters 48L, and 48T are all configured to support the skylight panes 30 in a manner that will be described in detail hereinafter.

Figure 8:
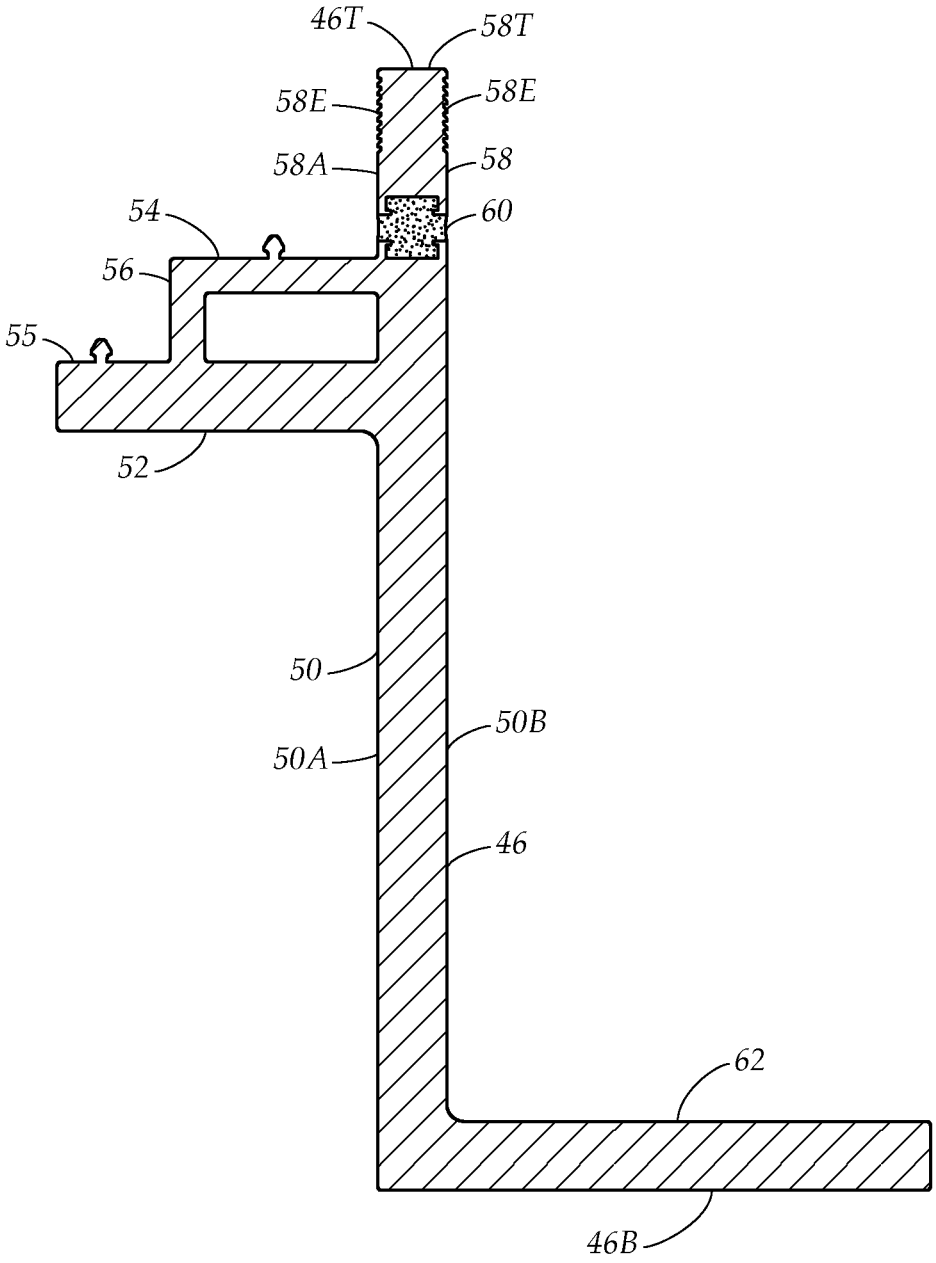
FIG. 8 is a cross sectional view of another embodiment of one of the framing members, per se.

Referring to FIG. 8, one of the framing members 46 is illustrated, having a top 46T, a bottom 46B, a vertical portion 50, and a support assembly 52 extending laterally from the vertical portion 50. The vertical portion 50 has an inward face 50A and an outward face 50B. Accordingly, with the inward face 50A establishing an inward direction with respect to the vertical portion 50 and the outward face 50B establishing an outward direction, clearly the support assembly 52 extends inwardly from the vertical portion 50. The support assembly 52 is tiered, having an upper support surface 54 and a lower support surface 55 that extend inwardly, and a vertical step 56 between the upper support surface 54 and lower support surface 55. Using a "stairs" analogy and terminology, the lower support surface 55 and upper support surface 54 is essentially like the "treads" in a staircase, with the vertical step 56 being analogous to a "riser" in between.

The framing member 46 also has an upper vertical part 58 that extends above the upper support surface 54, and is coextensive with the vertical portion 50. The upper vertical part 58 has an upper vertical part top 58T, and is connected to the vertical portion 50 with a thermal break 60. The thermal break 60 is made of an insulative material that connects and yet fully separates the upper vertical part 58 from the vertical portion 50. The insulative material is preferably a resin that is inserted or injected as part of the extrusion process for fabricating the framing member 46. The framing member itself, including the vertical portion 50, upper vertical part 58, and support assembly 52 is preferably made of a suitable structural material, a strong metal such as aluminum. The thermal break 60 is keyed, having a shape which includes portions that effectively lock within the upper vertical part 58 and vertical portion 50, to create a solid coextensive piece of material that comprises the framing member 46 once the resin hardens.

Figure 5:
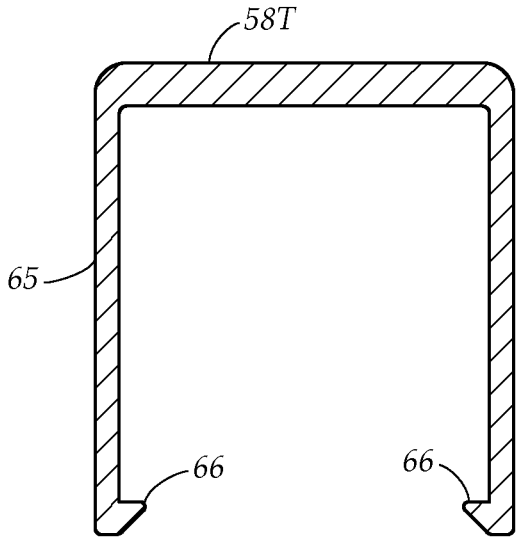
FIG. 5 is a cross sectional view, illustrating an upper vertical support cap, in accordance with principles of the present disclosure.

Referring still to FIG. 8 and also to FIG. 5, in order to be height adjustable, the upper vertical part 58 may include an upper vertical part body 58A and an upper vertical part cap 65 (FIG. 5). The upper vertical part body 58A has notched vertical edges 58E. The upper vertical part cap top 65 is a substantially u-shaped channel having the upper vertical part top 58T and two lower hooks 66. The upper vertical part cap 65 is adapted to extend over the upper vertical part body 58A and is pushed downardly thereupon until the upper vertical part top 58T is at its desired height. The cap 65 is positionable and remains in position thereupon by engaging the hooks 66 to the notched vertical edges 58E to adjust in height the upper vertical part top 58T.

Figure 7:
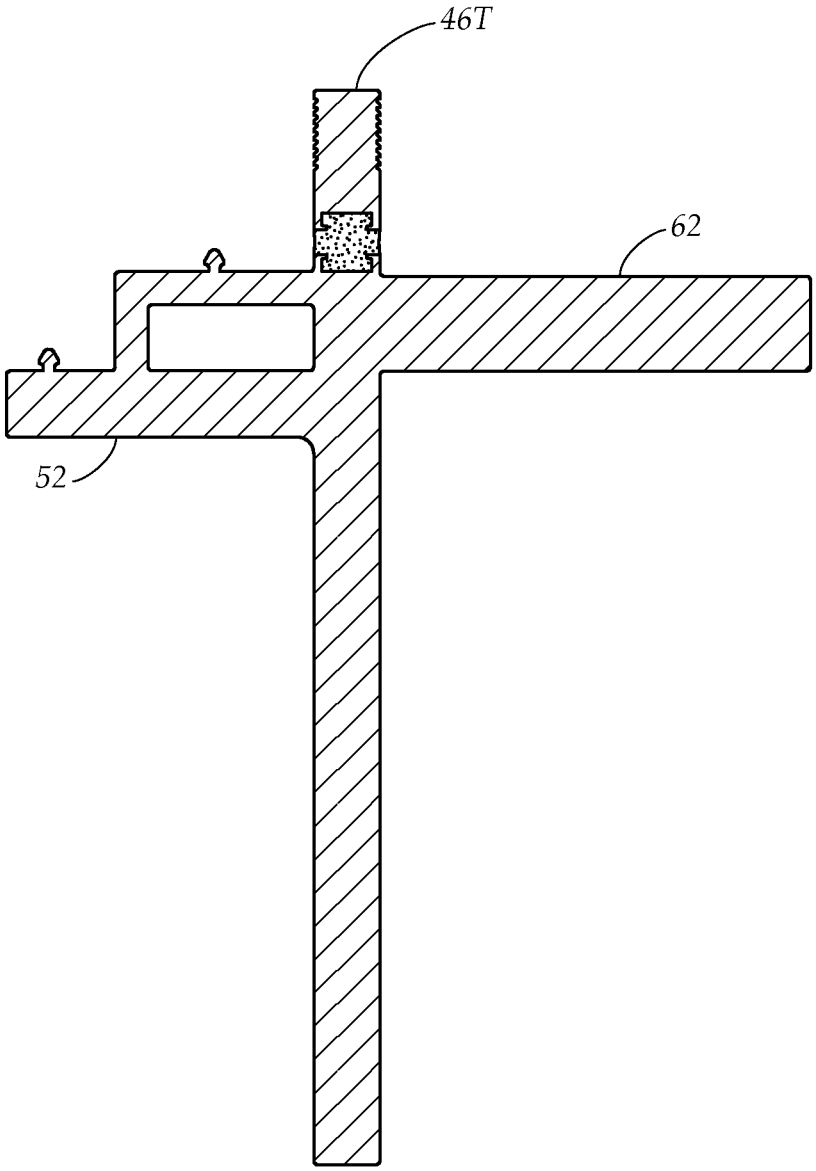
FIG. 7 is a cross sectional view of an embodiment of one of the framing members, per se.

The framing member 46 has a connecting flange 62 that extends laterally from the vertical portion for connection to a building structure 15 (see FIG. 3 momentarily), such as an I-beam or other suitable support structure. Note that the connecting flange 62 may be located near the bottom 46B as shown in FIG. 8. The connecting flange 62 may also be located closer to the top 46T, at substantially the same level as the support assembly 52, as shown in FIG. 7.

Figure 3:
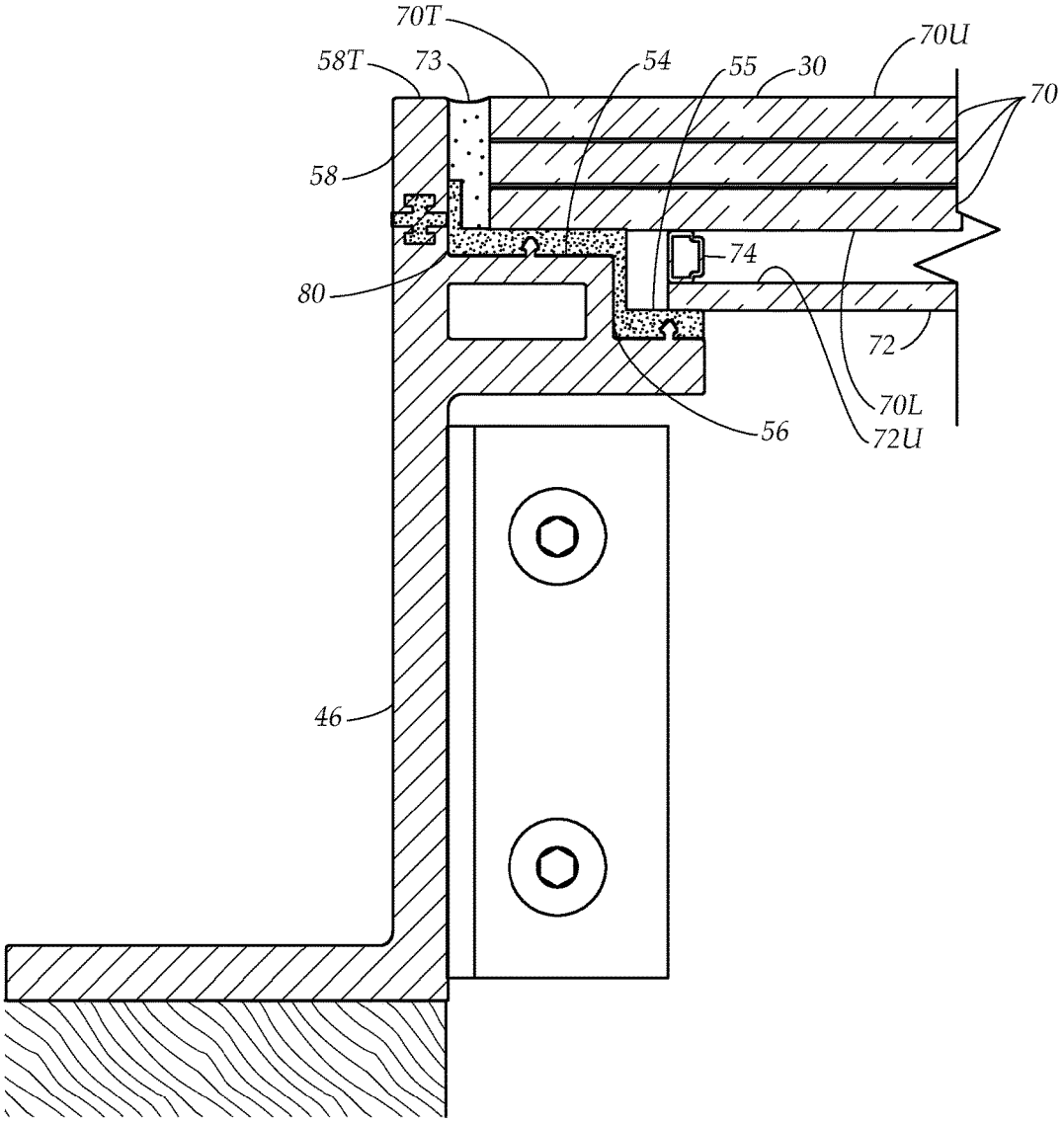
FIG. 3 is a cross sectional view with parts broken away, illustrating components of the skylight assembly, including one of the framing members, according to the present disclosure.

Referring now to FIG. 3, one of the skylight panes 30 is shown partially supported by one of the framing members 46. In particular, this skylight pane 30 includes three heavy, structural glass panels 70, each having a lower surface 70L and one significantly lighter and thinner thermal glass panel 72 that has an upper surface 70U. The structural glass panels 70 are thick and heavy, as they are intended to support the weight of multiple persons walking thereon, as well as providing a significant safety margin for even greater loading. The thermal glass panel 72 is linked to one of the structural glass panels 70 by a spacer 74 that extends against and seals to the lower surface 70L of said panel of structural glass 70, and the upper surface of the thermal glass panel 72 to create an insulating glass unit (IGU). Note that the spacer 74 is generally hollow, except for desiccant material contained therein, and cannot support significant weight. Accordingly, the weight of the structural glass panels 70 is not borne by the thermal panel 72, nor is it exerted upon the spacer 74. Instead, the structural glass panels 70 are supported by the upper support surface 54, while the thermal panel 72 is supported by the lower support surface 55. More particularly, however, the structural glass panels 70 and the thermal panel 72 rest upon a glass setting block 80. The glass setting block 80 is made of a rubbery, or rubber-like material, and acts as a gasket—cushioning the glass panels 70, 72 and sealing with the framing member 46. The framing element 46 creates a contour between the upper support surface 54, the vertical step 56, and the lower support surface 55. The glass setting block 80 follows this contour and extends between the structural glass panels 70 and upper support surface 54, and between the thermal panel 72 and the lower support surface 55. Optionally, the glass setting block 80 may also continue upwardly, along the upper vertical part 58. Preferably protrusions and openings on the framing member 46 and glass setting block 80 respectively, as seen in FIG. 3, help maintain the glass setting block 80 in position.

As illustrated in FIG. 3, gaps between the structural glass panels 70 and the upper vertical part 58 are filled with a silicon sealant 73. The structural glass panels 70 include an uppermost structural glass panel 70U, having a top surface 70T. Note that the top surface of the uppermost structural glass panel 70U is preferably equal and level in height to the top 58T of the upper vertical part 58. With the embodiment shown in FIG. 5 and FIG. 8, this height adjustment may be accomplished by adjusting the upper vertical part cap 65 with respect to the upper vertical part body 58A.

Figure 4:
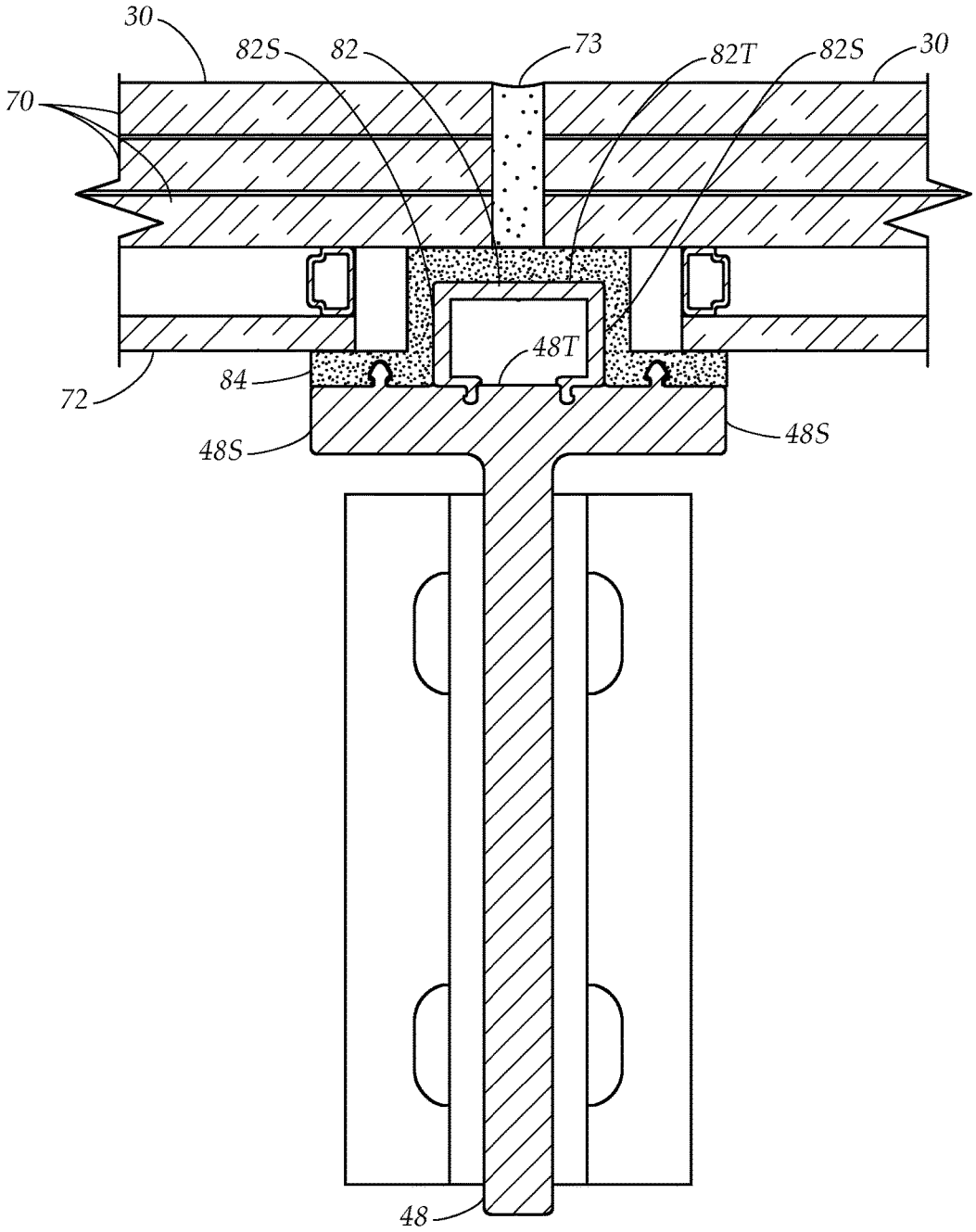
FIG. 4 is a cross sectional view with parts broken away, illustrating two panes of the skylight assembly, partially supported by one of the rafters.

FIG. 4 shows two adjacent skylight panes 30, as they meet, resting above and supported by one of the rafters 48. The rafter 48 is substantially T-shaped, having a broad rafter top 48T, the rafter top 48T having rafter side edges 48S. A support block 82 is positioned on the rafter top 48T and is substantially centered between the rafter side edges 49S. The support block 82 has a pair of block sides 82S and a block top 82T. Note that as indicated, the support block 82 may be a separate piece of material from the rafter 48, joined to the rafter top 48T by protrusions and openings. The support block 82 may also be formed of a continuous piece of material with the rafter 46.

The panels of structural glass 70 of the two adjacent skylight panes 30 are supported upon the block top 82T. The thermal glass panels 72 is supported upon the rafter top. A rafter glass setting block 84 is provided to directly support the structural glass panels 70 and thermal glass panel 72 upon the rafter 48, just as the glass setting block 80 is provided to support them upon the framing members 46 (the latter shown in FIG. 3). Like the glass setting block, the rafter glass setting block 84 is made of a rubbery material. The rafter glass setting block 84 is secured to the rafter top 48T, and extends on the rafter top 48T between the structural glass panels 70 and the rafter top 48T. The rafter glass setting block 84 also extends upwardly along one of the block sides 82S of the support block 82 atop the rafter, across the block top 82T, downwardly on the other of the block sides 82S, and then again across the rafter top 48T. The thermal panel 72 rests upon the rafter glass setting block 84, and is connected to the nearest structural glass panel 70 (without supporting the weight of the structural glass panel), with the spacer 74 to create an insulating glass unit therewith. Lateral space between structural glass panels 70 of adjacent panes 30 is filled with the silicon sealant 73 or suitable equivalent.

Figure 6:
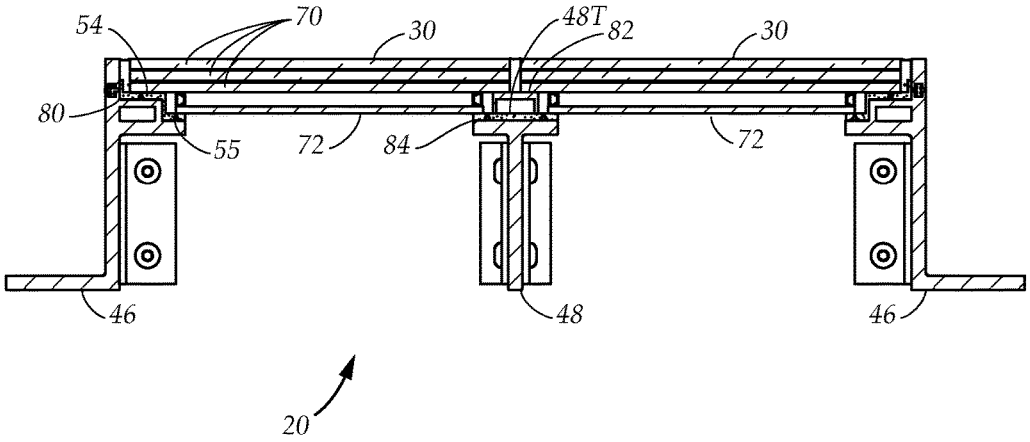
FIG. 6 is a cross sectional view, providing an overview of components illustrated in FIGS. 3 and 4.

FIG. 6 provides an overall view of the skylight 20 with two framing members 46 and one rafter 48 in between. Two adjacent panes 30 are each supported between one of the framing members 46 and the rafter 48. Each pane 30 has three panels of structural glass 70, supported by the upper support surface 54 of one of the framing members 46, and the support block 82 on the rafter 48 therebetween. Each pane 30 also has one panel of thermal glass 72 that extends parallel to the structural glass panels 70, supported by the lower support surface 55 of one of the framing members 46, and the rafter top 48T of the rafter 48 therebetween. The glass setting block 80 and the rafter glass setting block 84, provide the actual contact with the structural glass 70 and thermal glass 72, as supported on the framing members 46 and rafter 48, respectively. Accordingly, the structural glass 70 is fully supported by the framing members 46 and rafter 48, independently of the support provided to the thermal glass 72. Thus, an insulating glass unit (IGU) is created, without sacrificing the strength and walkability of the structural glass, and without crushing the IGU under the weight of the structural glass and the load it is designed to support.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a skylight system that is configured to provide thermal insulation while also having the structural strength to be walkable. The disclosure is illustrated by example in the drawing figures and throughout the written description. It should be understood that numerous variations are possible while adhering to the inventive concept. Such variations are contemplated as being a part of the present disclosure.

What is claimed is:

1. A skylight assembly, comprising:

an outer frame, the outer frame having framing members that define an interior space, the framing members each having a vertical portion having an inward surface that faces the interior space, the framing members each having a support structure that includes an upper support surface that extends inwardly, a lower support surface that extends inwardly, and a vertical step between the upper support surface and lower support surface;

at least one panel of structural glass, spanning a portion of the interior space, having a lower edge that is supported by the upper support surface;

a panel of thermal glass having an upper edge, at least one of the at least one panel of structural glass thicker than the thermal glass panel, the thermal glass panel having a lower edge that is supported by the lower support surface and extends parallel to the at least one panel of structural glass; and a spacer, extending between the at least one panel of structural glass and the panel of thermal glass, the spacer extending against and sealed to the lower edge of one of the panels of said at least one panel of structural glass and the upper edge of the thermal glass panel to create an insulating glass unit between the thermal glass panel and said at least one panel of structural glass.

2. The skylight as recited in claim 1, further comprising a glass setting block, the glass setting block made of a rubbery material, the glass setting block following a contour provided by the upper support surface, the vertical step, and the lower support surface, the glass setting block extending between the upper support surface and one panel of the at least one panel of structural glass, and between the lower support surface and panel of thermal glass.

3. The skylight as recited in claim 2, further comprising an inner frame, the inner frame including at least one rafter extending between two of the framing members, the rafter including a broad rafter top, rafter side edges, and a support block positioned on the rafter top and substantially centered between the rafter side edges, the support block having a pair of block sides and a block top, the at least one panel of structural glass resting upon the block top, the panel of thermal glass resting upon the rafter top.

4. The skylight as recited in claim 3, further comprising a rafter glass setting block, the rafter glass setting block made of a rubbery material, secured to rafter top, and extending on the rafter top between the thermal glass panels and rafter top, upwardly along one of the block sides, across the block top between the at least one panel of structural glass panels and block top, downwardly on the other of the block sides, and then again across the rafter top.

5. The skylight as recited in claim 2, wherein each framing member has an upper vertical part extending upwardly from and coextensive with the vertical portion, the upper vertical part having an upper vertical part top, wherein the at least one panel of structural glass extend alongside the upper vertical part, wherein the at least one panel of structural glass includes an uppermost structural glass panel having an uppermost structural glass panel top that is substantially level in height with the upper vertical part top.

6. The skylight as recited in claim 5, wherein the upper vertical part includes an upper vertical part body and an upper vertical part cap, the upper vertical part body has notched vertical edges, the upper vertical part cap is a substantially u-shaped channel having the upper vertical part top and two lower hooks, the upper vertical part cap extends over the upper vertical part body and is positionable thereupon by engaging the hooks to the notched vertical edges to adjust in height the upper vertical part top.

7. The skylight as recited in claim 6, wherein the upper vertical part is made of a metal material, wherein the vertical portion is made of the same metal material, and wherein the vertical portion and upper vertical part is connected by a thermal break, the thermal break is made of an insulative material.

8. A skylight assembly, comprising:

an outer frame, the outer frame having framing members that define an interior space, the framing members each having a vertical portion having an inward surface that faces the interior space, the framing members each having a support structure that includes an upper support surface that extends inwardly, a lower support surface that extends inwardly, and a vertical step between the upper support surface and lower support surface;

an inner frame, having at least one rafter, the at least one rafter extending between two of framing members, each rafter having a rafter top, rafter side edges, and a support block positioned on the rafter top and substantially centered between the rafter side edges, the support block having a pair of block sides and a block top; and at least two skylight panes, each pane spanning part of the interior space, each pane having:

at least one panel of structural glass, having a lower edge that is supported by the upper support surface of one of the framing members, and supported by the block top of one of the at least one rafters, at least one panel of thermal glass having an upper edge, at least one of the at least one panel of structural glass thicker than the at least one panel of thermal glass, the at least one panel of thermal glass having a lower edge that is supported by the lower support surface of one of the framing members, extends parallel to the at least one panel of structural glass for that pane, and is supported by the rafter top of one of the at least one rafters;

a spacer, extending between the at least one panel of structural glass and the at least one panel of thermal glass, the spacer extending against the lower edge of one of the panels of structural glass, and against the upper edge of the thermal glass.

9. The skylight assembly as recited in claim 8, further comprising:

at least one glass setting block associated with each pane, said glass setting block made of a rubbery material, the glass setting block following a contour provided by the upper support surface, the vertical step, and the lower support surface of one of the framing members that supports the at least one panel of structural glass of said pane, the glass setting block extending between the upper support surface and one panel of the at least one panel of structural glass of said pane, and between the lower support surface and one panel of the at least one panel of thermal glass of said pane; and a rafter glass setting block associated with each pane, each rafter glass setting block made of a rubbery material, secured to rafter top that supports the thermal glass panel of said pane, and extending on the rafter top between the at least one panel of thermal glass panel of said pane and said rafter top, upwardly along one of the block sides atop said rafter, across the block top between the at least one panel of structural glass and the block top, downwardly on the other of the block sides, and then again across said rafter top.

10. The skylight assembly as recited in claim 9, wherein each framing member has an upper vertical part extending upwardly from and coextensive with the vertical portion, the upper vertical part having an upper vertical part top, wherein the at least one panel of structural glass panels extend alongside the upper vertical part, wherein the at least one panel of structural glass includes an uppermost structural glass panel having an uppermost structural glass panel top that is substantially level in height with the upper vertical part top.

11. The skylight as recited in claim 10, wherein the upper vertical part includes an upper vertical part body and an upper vertical part cap, the upper vertical part body has notched vertical edges, the upper vertical part cap is a substantially u-shaped channel having the upper vertical part top and two lower hooks, the upper vertical part cap extends over the upper vertical part body and is positionable thereupon by engaging the hooks to the notched vertical edges to adjust in height the upper vertical part top.

12. The skylight as recited in claim 11, wherein the upper vertical part is made of a metal material, wherein the vertical portion is made of the same metal material, and wherein the vertical portion and upper vertical part is connected by a thermal break, the thermal break is made of an insulative material.

* * * * *